US009011097B2

(12) United States Patent
Yokoyama et al.

(10) Patent No.: US 9,011,097 B2
(45) Date of Patent: Apr. 21, 2015

(54) TURBINE WHEEL

(75) Inventors: Takao Yokoyama, Tokyo (JP); Katsuyuki Osako, Tokyo (JP); Toyotaka Yoshida, Tokyo (JP); Motoki Ebisu, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 236 days.

(21) Appl. No.: 13/264,610

(22) PCT Filed: Jul. 28, 2010

(86) PCT No.: PCT/JP2010/062656
§ 371 (c)(1), (2), (4) Date: Nov. 16, 2011

(87) PCT Pub. No.: WO2011/055575
PCT Pub. Date: May 12, 2011

(65) Prior Publication Data

US 2013/0004321 A1 Jan. 3, 2013

(30) Foreign Application Priority Data

Nov. 5, 2009 (JP) ..... 2009-253773

(51) Int. Cl.
*F01D 5/14* (2006.01)
*F01D 5/04* (2006.01)
*F01D 1/28* (2006.01)

(52) U.S. Cl.
CPC *F01D 5/048* (2013.01); *F01D 1/28* (2013.01); *F05D 2240/307* (2013.01); *F05D 2260/20* (2013.01); *F05D 2250/70* (2013.01); *F05D 2220/40* (2013.01)

(58) Field of Classification Search
USPC ..... 415/120, 104, 106, 107, 171.1, 174.5; 416/183, 185, 186 R, 188, 223 B, 416/DIG. 2, DIG. 5
See application file for complete search history.

(56) References Cited

U.S. PATENT DOCUMENTS

| | | | | |
|---|---|---|---|---|
| 2,941,780 | A | 6/1960 | Von Der Nuell et al. | |
| 5,222,742 | A * | 6/1993 | Roberts | 277/420 |
| 5,263,315 | A * | 11/1993 | Shekleton et al. | 60/789 |
| 5,297,928 | A * | 3/1994 | Imakiire et al. | 415/112 |
| 2004/0115044 | A1 | 6/2004 | Osako et al. | |

(Continued)

FOREIGN PATENT DOCUMENTS

| | | | |
|---|---|---|---|
| CN | 1386983 | A | 12/2002 |
| CN | 1737378 | A | 2/2006 |
| JP | 60-28201 | U | 2/1985 |

(Continued)

OTHER PUBLICATIONS

Chinese Office Action, dated Sep. 27, 2013, for Chinese Application No. 201080014806.6 with an English translation.

(Continued)

*Primary Examiner* — Edward Look
*Assistant Examiner* — Danielle M Christensen
(74) *Attorney, Agent, or Firm* — Birch, Stewart, Kolasch & Birch, LLP

(57) ABSTRACT

A turbine wheel includes a plurality of blades having a scallop cut-out profile. The scallop cut-out profile is formed by cutting-out a back side wall part of the blade between the suction surface side of a blade part and the pressure surface side of the adjacent blade.

12 Claims, 7 Drawing Sheets

(56) References Cited

U.S. PATENT DOCUMENTS

| | | | | |
|---|---|---|---|---|
| 2006/0039791 | A1 | 2/2006 | Kim | |
| 2009/0074580 | A1 * | 3/2009 | Wu et al. | 416/183 |

FOREIGN PATENT DOCUMENTS

| | | | |
|---|---|---|---|
| JP | 63-154702 | U | 10/1988 |
| JP | 10-131704 | A | 5/1998 |
| JP | 2000-170541 | A | 6/2000 |
| JP | 2003-201802 | A | 7/2003 |
| JP | 4240512 | B1 | 3/2009 |
| WO | WO 03/010433 | A1 | 2/2003 |

OTHER PUBLICATIONS

Decision to Grant a Patent effective Jan. 7, 2014 issued in the corresponding Japanese Application No. 2009-253773 with an English translation.

Chinese Notice of Allowance issued in Chinese Application No. 201080014806.6 on Dec. 24, 2014.

* cited by examiner a: Pressure surface side inlet
b: Pressure surface side middle
c: Pressure surface side corner
d: Minimum diameter location
e: Suction surface side corner
f: Suction surface side middle
g: Suction surface side inlet

PRIOR ART

PRIOR ART

TURBINE WHEEL

BACKGROUND OF THE INVENTION

1. Field of the Invention

The present invention relates to a structure of a turbine wheel used for a turbine of a gas turbine or an exhaust gas turbocharger; the invention particularly relates to a turbine wheel having what they call a scallop part, namely, a wavy-edge part on the back side of the turbine wheel, the scallop part being formed by cutting out of the back side of a radial turbine, so as to leave the blade parts.

2. Background of the Invention

As a rule, there are two types of turbine wheel in the radial turbine: a turbine wheel (shown in FIG. 8(*a*)) provided with what they call a scallop part 01, namely, a wavy-edge part on the back side (the rear side) of the turbine wheel, the scallop part being formed by cutting out of the back side of a radial turbine; and, a turbine wheel (shown in FIG. 8 (*b*)) provided with a back side wall (part) 02 of a circular disk shape, the scallop part being not formed on the back side of the turbine wheel.

The turbine wheel with the scallop part is advantageous in rotational inertia reduction, material cost reduction and thermal stress reduction; however, the efficiency of the turbocharger in which the turbine wheel with the scallop part is installed is inclined to be inferior to the efficiency of the turbocharger that is provided with the turbine wheel with not the scallop part but the back side wall 02.

Nevertheless, in response to the ever stricter regulations regarding exhaust gas emission and energy conservation in recent years, the quicker response performance regarding the turbocharger is being required and a reappraisal of the turbine wheel with the scallop part is being performed.

Patent Reference 1 (JP2000-170541) proposes the conventional technology regarding the turbine wheel with not the scallop part but the back side wall, whereas Patent Reference 2 (JP1998-131704) and Patent Reference (JP2003-201802) propose the conventional technology regarding the turbine wheel with the scallop part.

According to the technology disclosed in Patent Reference 1, the outer periphery diameter of the back side wall of the circular disk shape approximately agrees with the diameter of the blade parts so that the strength or rigidity of the turbine rotor is enhanced. Further, since the back side wall part blocks the gap between the turbine rotor and the wall part on the casing side (on the stator side), the leakage of the working fluid toward the rear side of the turbine rotor (i.e. hereby the turbine wheel) is prevented; thus, the leakage loss is reduced.

Further, according to Patent Reference 2, as depicted in FIG. 9, a turbine wheel 03 is provided with a plurality of blade parts 04; a scallop part 06 is formed in a main wall 05 (that is almost the same as the back side wall in Patent Reference 2) inside the back side of the blade parts 04 of the turbine wheel 03. Each blade part (in a cross-section profile regarding the blade part) includes a suction surface 012, a minimum radius part 08 and a pressure surface (a pressure surface) 013; the minimum radius part 08 between a blade part 04 and the adjacent blade part 04 is biased toward the suction surface side 012 so that the suction surface 012 of a blade part and the pressure surface 013 of the blade part are unsymmetrically arranged with regard to the blade part (namely, unsymmetrical with regard to the left side and the right side of the blade camber line). Thus, the angle which the pressure surface 013 and the front side vertical plane of the main wall 05 form becomes acuter, the front side vertical plane of the main wall 05 being vertical to the rotation axis. Thus, in this area of the acuter corner, the factor regarding the energy dissipation loss is increased so that the fluid flow streaming from the pressure surface side 13 to the suction surface side 12 through the rear side of the blade part is constrained; and, the efficiency deterioration due to the leakage is constrained.

Further, according to Patent Reference 3, as depicted in FIG. 10, a turbine wheel 020 is provided with a plurality of blade parts 24; a scallop part 021 is formed in a circular main wall 022 between the back side of the blade part 024 and the adjacent the blade part 024; a minimum radius part is formed on the scallop hem part (the scallop profile) so that the distance from the center of the circular main wall 022 to the minimum radius part is minimum. Further, the scallop part includes a suction surface side surface 026 of a blade part 024 and a (positive) pressure side surface 028 of the adjacent blade part 024; and, the minimum radius part is located on the (positive) pressure surface side with regard to a middle location in a hoop direction between the (positive) pressure side surface and the suction surface side surface. Thus, the scallop part 021 is formed unsymmetrically between the (positive) pressure side surface 028 and the suction surface side surface 026. And, in this way, the corner vortex flow is constrained in the neighborhood along the suction surface side surface 026 of the scallop part 021, so that turbine efficiency is enhanced.

REFERENCES

Patent References

Patent Reference 1: JP2000-170541
Patent Reference 2: JP1998-131704
Patent Reference 3: JP2003-201802

SUMMARY OF THE INVENTION

Subjects to be Solved

The scallop profile shown in Patent Reference 2 as well as Patent Reference 3 is unsymmetrically formed between a blade part and the adjacent blade part; the minimum radius part of the scallop profile is sifted to the suction surface side or the (positive) pressure surface side. In FIG. 9, the scallop part 06 (the inner radius side part of the scallop part 06) is smoothly sloped toward the main wall 05; similarly, in FIG. 10, the scallop part 021 is smoothly sloped toward the main wall 022. And, at the tip end side of the blade part, the width of the scallop part (namely, the width between a scallop part and the adjacent scallop part) almost agrees with the thickness of the blade part.

In the disclosure of conventional technologies, however, there is no improvement regarding the scallop profile on the tip end side of the blade part, the tip end side being get firstly exposed to the exhaust gas inlet flow; for instance, the disclosed technology of Patent Reference 2 as well as Patent Reference 3 is insufficient in constraining the leakage flow from the (positive) pressure surface side to the suction surface side; and, the further improvement is desired. The applicant of this invention performs the design of experiments on the analyses regarding how each part of the scallop profile influences on the leakage flow on the rear side of the blade part; according to the findings of the inventors, the width of the scallop parts (i.e. the thickness of the blade part on the back side of the turbine wheel) on the tip end side of the blade or the scallop is effectively widened so as to constrain the leakage flow on the rear side of the blade part.

Hence, the present invention aims at providing a turbine wheel that can constrain the leakage flow on the rear side of the blade part so as to enhance the turbine efficiency, in the manner that the width between the scallop part and the adjacent scallop part on the tip end side of the scallop is increased.

Incidentally, it is hereby noted that the scallop part is formed in the turbine wheel on the back side of the blade parts as well as on the outer periphery side of the hub part on the wheel back-side.

Means to Solve the Subjects

In order to overcome the difficulties of the conventional technologies, the present invention discloses a first aspect thereof, namely, a turbine wheel that includes, but not limited to, a plurality of blades being formed in a scallop shape by cutting-out a back plate side of the blades between a suction surface of a blade and a pressure surface of the adjacent blade, wherein an suction surface side extended part is formed along a tip end part of the scallop shape in the radial direction so as to extend the thickness of the blades toward the suction surface.

According to the above first aspect of the invention, the blade part is provided with a suction surface side extended part in the neighborhood of the suction surface side of the blade part so that the thickness of the blade part on the tip end side of the scallop cut-out profile is increased. Thus, the leakage flow on the rear side of the blade part from the (positive) pressure surface side to the suction surface side can be effectively constrained.

The experimental design is performed to evaluate the influence of each location of the scallop profile on the leakage flow, the locations being a pressure surface side inlet a, a pressure surface side middle b, a pressure surface side corner c, a minimum diameter location d, a suction surface side corner e, a suction surface side middle f, and a suction surface side inlet g, as shown in FIG. 2. According to the result of the experimental design analysis, it is found that the location a, namely, the pressure surface side inlet has the greatest influence on the constraint of the leakage flow.

Accordingly, the leakage flow on the rear side of the blade part can be effectively constrained, by forming the suction surface side extended part in the neighborhood of the suction surface side of the blade part, on the tip end side of the scallop parts (i.e. on the tip end side of the blade part). In addition, this extended part of the blade parts on the tip end side as well as on the back side of the turbine wheel does not bring a drastic increase in the rotational inertia of the turbine wheel in comparison with the conventional scallop profile (i.e. the conventional blade part on the back side of the wheel); thus, no deterioration in the response performance is brought. In this way, the leakage flow on the rear side of the blade part can be effectively constrained, and the turbine efficiency can be enhanced.

The suction surface side extended part may be provided mainly on the tip end side of the blade part (mainly on the tip end side of the scallop profile); or, the projecting-out width part may be provided so that the extended width on the blade root part side is smaller than the extended width on the tip end side. Further, the extended part may form a strip area in the cross section whose plane is at right angles to the rotation axis on the back side of the turbine wheel, so that the projecting-out width is an almost constant width along the blade height from the tip end side to the root side of the blade. When the extended part is provided mainly on the tip end side of the blade part, the increase of the rotational inertia can be further constrained and the response performance regarding the turbine can be improved. Further, the reduction effect regarding the working stresses in the turbine wheel can be further achieved.

Hereby, based on FIGS. 3(*b*), 5(*b*) and 6(*b*), the situation regarding the difference between the pressure on the pressure surface side of the blade part and the pressure on the suction surface side of the blade part is explained; further, it is explained how the difference is apparently reduced in a case where the extended part is provided. FIG. 3(*b*) shows the situation regarding the difference between the pressure distribution on the pressure surface side and the pressure distribution on the suction surface side in a case where the suction surface side extended part is provided on the suction surface side; FIG. 5(*b*) shows the situation regarding the difference between the pressure distribution on the pressure surface side and the pressure distribution on the suction surface side, in a case where the pressure surface side extended part is provided on the pressure surface side; FIG. 6(*b*) shows the situation regarding the difference between the pressure distribution on the pressure surface side and the pressure distribution on the suction surface side, in a case where the suction surface side extended part is provided on the suction surface side as well as on the pressure surface side.

According to the first aspect of the invention, as described in FIG. 3(*b*), the conventional pressure difference ΔP (in a case where the turbine wheel is provided with not a scallop part but the main wall) between the pressure surface side and the suction surface side is apparently reduced to the improved pressure difference ΔQ1 in a case where the suction surface side extended part is provided on the suction surface side. In this way, it is understood that, thanks to the apparent drop of the pressure difference from conventional pressure difference ΔP to the improved pressure difference ΔQ1, the leakage flow on the rear side of the blade part can be constrained.

In the next place, the present invention discloses a second aspect thereof, namely, a turbine wheel that includes, but not limited to, a plurality of blades being formed in a scallop shape by cutting-out a back plate side of the blades between a suction surface of a blade and a pressure surface of the adjacent blade, wherein an pressure surface side extended part is formed along a tip end part of the scallop shape in the radial direction so as to extend the thickness of the blades toward the pressure surface.

According to the above second aspect of the invention, as is the case with the first aspect, by providing the extended part on the tip end side of the blade part as well as on the back side of the blade part, without the deterioration of the response performance, the leakage flow on the rear side of the blade part can be effectively constrained and the turbine efficiency can be enhanced.

Further, the pressure surface side extended part may be provided mainly on the tip end side of the blade part; or, the projecting-out width part may be provided so that the extended width on the blade root part side is smaller than the extended width on the tip end side. Further, the extended part may form a strip area in the cross section whose plane is at right angles to the rotation axis on the back side of the turbine wheel, so that the projecting-out width is an almost constant width along the blade height from the tip end side to the root side of the blade. When extended part is provided mainly on the tip end side of the blade part, the increase of the rotational inertia can be further constrained and the response performance regarding the turbine can be improved. Further, the reduction effect regarding the working stresses in the turbine wheel can be further achieved.

According to the second aspect of the invention, as described in FIG. 5(*b*), the conventional pressure difference ΔP (in a case where the turbine wheel is provided with not a scallop part but the main wall) between the pressure surface side and the suction surface side is apparently reduced to the improved pressure difference ΔQ2 in a case where the pressure surface side extended part is provided on the pressure surface side. In this way, it is understood that, thanks to the apparent drop of the pressure difference from conventional pressure difference ΔP to the improved pressure difference ΔQ2, the leakage flow on the rear side of the blade part can be constrained.

It is hereby noted that the pressure difference ΔQ1 in the first aspect is smaller (a bit preferable) the pressure difference ΔQ2 in the second aspect; this is because the static pressure distribution rather steeply changes in the area near the suction surface side in comparison with the area near the pressure surface side.

In the next place, the present invention discloses a third aspect thereof, namely, a turbine wheel that includes, but not limited to, a plurality of blades being formed in a scallop shape by cutting-out a back plate side of the blades between a suction surface of a blade and a pressure surface of the adjacent blade, wherein an pressure surface side extended part and an suction surface side extended part are formed along a tip end part of the scallop shape in the radial direction so as to extend the thickness of the blades toward the pressure surface and the suction surface.

According to the third aspect of the invention, as described in FIG. 6(*b*), the conventional pressure difference ΔP (in a case where the turbine wheel is provided with not a scallop part but the main wall) between the pressure surface side and the suction surface side is apparently reduced to the improved pressure difference ΔQ3 in a case where the suction surface side extended part is provided on the suction surface side as well as on the pressure surface side. In this way, it is understood that, thanks to the apparent drop of the pressure difference from conventional pressure difference ΔP to the improved pressure difference ΔQ3, the leakage flow on the rear side of the blade part can be constrained. Out of the first to third aspects of the invention, the configuration according to the third aspect has the greatest influence on the leakage flow constraint, with the negative projecting-out width part in the neighborhood of the suction surface side of the blade part as well as with the pressure surface side extended part in the neighborhood of the pressure surface side of the blade part.

A preferable embodiment according to the above the first, the second and the third aspect of the present invention is the turbine wheel, wherein the extended width of the pressure surface side extended part or the suction surface side extended part is set in a range from 1/20 to 1/3 of the pitch which is a distance from a blade to the adjacent blade at the approximately 90% height of the scallop shape.

According to the above described embodiment of the invention, as shown in FIG. 3(*a*), a concrete example as to the extended width of the extended part is preferably set in a range from 1/20 to 1/3 of the pitch P that is a distance from a blade to the adjacent blade along a hoop direction circle at the almost 90% height (90% of the whole height H regarding the blade part) of the blade part on the back side of the turbine wheel. The extended width further preferably set in a range greater than or equal to 1/12 of the pitch P.

When the extended width is smaller than 1/20 of the pitch P, the improved pressure difference ΔQ1 cannot be expected, as shown in FIG. 3(*b*). Thereby, the conventional pressure difference ΔP between the pressure surface side and the suction surface side is apparently reduced to the improved pressure difference ΔQ1. In other words, when the extended width is smaller than 1/20 of the pitch P, this expected pressure difference reduction (ΔP−ΔQ1) cannot be expected. On the other hand, when the extended width exceeds 1/3 of the pitch P, the expected pressure difference reduction (ΔP−ΔQ1) cannot be effectively increased. On the contrary, the rotational inertia of the wheel increases so that the advantage of adopting the scallop type turbine wheel is spoiled.

In this way, the extended width is preferably smaller than 1/3 of the pitch P; and, when the extended width is greater than or equal to 1/12 of the pitch P, a remarkable pressure difference can be achieved.

Another preferable embodiment according to the above the first, the second and the third aspect of the present invention is the turbine wheel, wherein the pressure surface side extended part or the suction surface side extended part is formed in a strip-shape so that the extended width is approximately constant value from the tip end side to the root side.

In this way, the pressure surface side extended part is extended on the pressure surface side or on the suction surface side of the blade part so that the width is an almost constant width along the camber line of the blade part from the tip end side to the root side of the blade, the projecting-out width part forming a strip area; the projecting-out width part is can be easily casted, welded or machined.

Another preferable embodiment according to the above the first, the second and the third aspect of the present invention is the turbine wheel, wherein a groove is formed on a back plate in the radial or spiral direction, the back plate being located facing a back surface of at least one of the pressure surface side extended part and the suction surface side extended part, so as to increase back surface pressure applied to the area between the back surfaces of the blades and the back plate.

As described above, a back-surface wall facing the extended part on the rear side of the turbine wheel is formed so that a gap space is formed between the back surface wall (on the casing side) and the back side surface of the turbine wheel; and, a plurality of grooves is formed along the radial lines or the spiral curves on the surface of the back-surface wall so that the pressure of the fluid streaming through the gap is increased. Thus, the leakage flow on the rear side of the blade part from the pressure surface side to the suction surface side can be constrained. Hence, in addition to the effect of the pressure surface side extended part on the pressure surface side or on the suction surface side, the leakage flow is constrained by the effect of the grooves.

Effects of the Invention

According to the present invention, the tip end side of the scallop parts (i.e. hereby, of the blade parts) are provided with the suction surface side extended parts on the suction surface side of the blade part or toward the positive pressure area on the pressure surface side. Thus, the present invention can provide the turbine wheel provided with the scallop parts, wherein the leakage flow on the rear side of the blade parts from the positive pressure area to the suction surface area can be effectively constrained so that the turbocharger efficiency can be enhanced.

BRIEF DESCRIPTION OF THE DRAWINGS

FIG. 7(*a*) shows a cross-section profile regarding a plurality of grooves; FIG. 7(*b*) shows an example of spiral grooves;

FIG. 8(*a*) shows a bird view of a turbine wheel that is provided with a scallop part; FIG. 8(*b*) shows a bird view of a turbine wheel that is provided with not a scallop part but a circular back side wall;

DETAILED DESCRIPTION OF THE PREFERRED MODES

Hereafter, the present invention will be described in detail with reference to the modes or embodiments shown in the figures. However, the dimensions, materials, shape, the relative placement and so on of a component described in these modes or embodiments shall not be construed as limiting the scope of the invention thereto, unless especially specific mention is made.

First Mode

Based on FIGS. 1 to 4, a first mode of the present invention is now explained.

Figure 1:
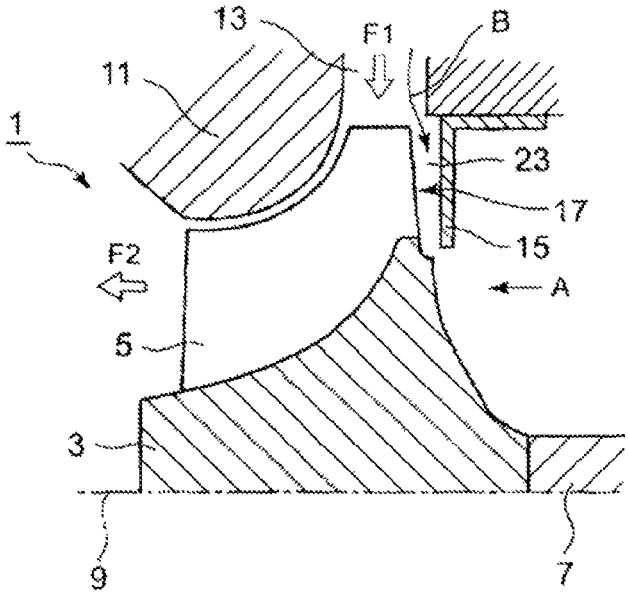
FIG. 1 schematically shows an upper half side of a turbine wheel in a cross-section including the rotation axis.

FIG. 1 schematically shows an upper half side of a turbine wheel 1 in a cross-section including the rotation axis, the upper half being the area above the rotation axis;

As shown in FIG. 1, the turbine wheel 1 includes, but not limited to: a hub part 3, a plurality of blade parts (or simply blades) fixed to the outer periphery surface of the hub part, and a rotor shaft 7. Thereby, the rotor shaft 7 and the hub part 3 may be integrated into one piece. The hub part 3 and the rotor shaft 7 rotate around a rotation axis 9; namely, the hub part 3 and the rotor shaft 7 have the same rotation axis. Each blade part 5 is formed on the outer periphery surface of the hub part so that a blade part and the adjacent blade part are arranged at a prescribed interval; the exhaust gas streams into the turbine through an inlet F1 and streams out of the turbine through an outlet F2. The he blade parts 5 are formed so that the exhaust gas flow efficiently gives rotational moment (torque) to the blade parts 5; thus, the exhaust gas energy is efficiently transferred to the rotor shaft 7 via the hub part 3.

Further, on the outer periphery side of the blade parts 5, a casing member 11 is provided so that the casing member 11 houses the blade parts 5; the casing member 11 is provided with an inlet passage 13 to feed the exhaust gas toward the gas inlet of the blade parts 5. Further, on the rear side of the blade parts 5, namely, on the rotor shaft side of the hub part 3, a back plate 15 is arranged so that the back plate 15 faces to the turbine wheel (i.e. the back side of the blade parts 5) and forms a back-surface wall facing the turbine wheel.

Figure 2:
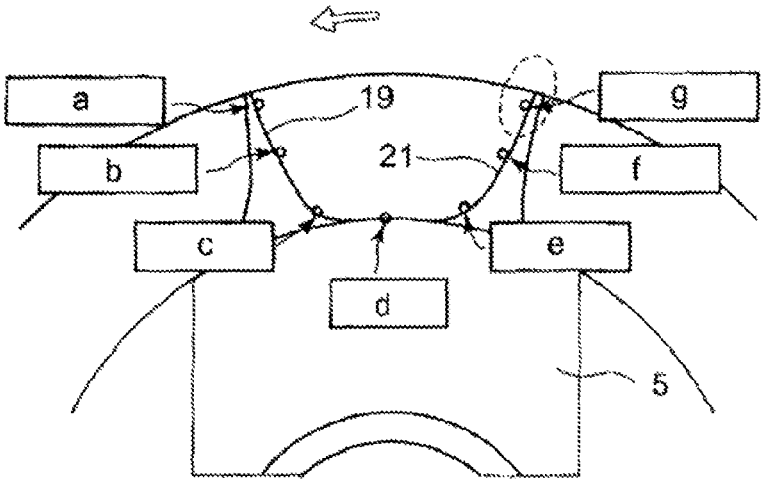
FIG. 2 shows a front view of the turbine wheel in the direction of A-arrow in FIG. 1; and, FIG. 2 shows the location points on the scallop profile, the location points being related to the numerical analysis.

Further, a scallop (part) 17 is formed on the back surface side of the blade parts 5, namely, on the rotor shaft 7 side of the hub part 3. The profile of the scallop part 17 is depicted in FIG. 2 as the plan view of the A-arrow direction in FIG. 1, as well as, in FIG. 3(*a*). The scallop part 17 is formed between a blade part 5 and the adjacent blade part 5, namely, between the pressure surface 19 of a blade part and the suction surface side 21 of the adjacent blade part, by cutting out of the back side of the turbine wheel.

Hereby, the exhaust gas flow through a gap 23 between the back side (the back side) of the blade parts 5 and the back plate 15 is now explained.

Apart of the exhaust gas streaming toward the front edge (the leading edge) of the blade parts 5 from the inlet passage 13 leaks through the gap 23 between the back side of the blade parts 5 and the back plate 15, in the direction toward the rotor shaft 7. Further, there is a pressure difference between the pressure surface side 19 of a blade part 5 and the suction surface side 21 of the blade part 5; thus, the exhaust gas leaks from the pressure surface side 19 to the suction surface side 21 through the gap 23 formed between the rear side of the blade parts 5 and the back plate 15. Accordingly, a part of the energy included in the exhaust gas on the pressure surface side 19 is dissipated, while the gas is leaking through the gap; and, the exhaust gas having leaked into the suction surface side 21 disturbs the main current on the suction surface side 21 so that the driving torque generated by the main current may be reduced.

In order to constrain the leakage flow from the pressure surface side to the suction surface side through the gap on the rear side of the blade parts, the present invention provides a constraining means (a device) in which the projecting-out width of the turbine wheel along the scallop part 17 in the rotation hoop direction at each height level of the back side of the blade 5 is extended so that the leakage flow from the pressure surface side to the suction surface side through the gap on the rear side of the blade parts 5 is constrained. The scallop part is formed in the turbine wheel on the back side of the blade parts as well as on the outer periphery side of the hub part on the wheel back-side.

Further, in the present invention, it is taken into consideration where the projecting-out width along the scallop part is to be effectively extended; thus, by use of an approach according to experimental design, sensitivity analysis is performed with regard to the height level as the control factor, the height level being a height in the height direction of the blade part 5. To be more specific, the control factors in the design of experiments are the positions on the profile of the scallop part as depicted in FIG. 2: a pressure surface side inlet a, a pressure surface side middle b, a pressure surface side corner c, a minimum diameter location d, a suction surface side corner e, a suction surface side middle f, and a suction surface side inlet g. According to the result of the sensitivity analysis, the factor a, namely, the pressure surface side inlet has the greatest influence on the constraint of the leakage flow.

Figure 3A:
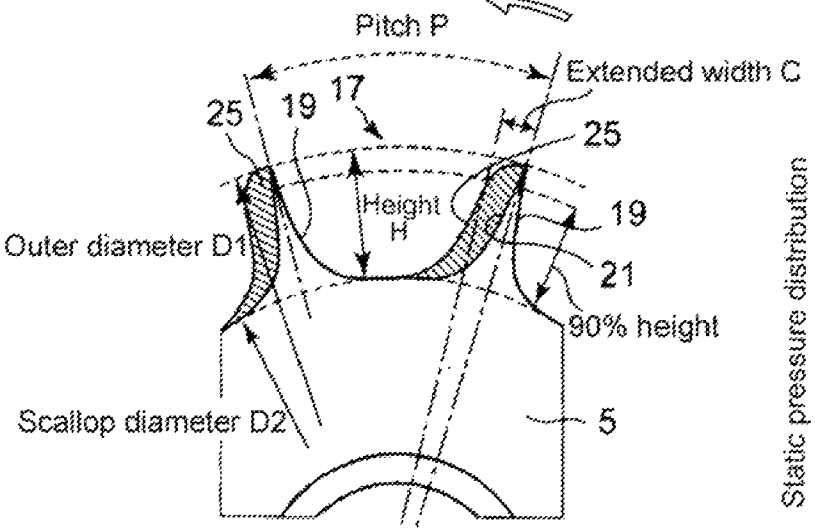
FIG. 3(*a*) shows a scallop profile according to a first mode of the present invention; in relation to FIG. 3(*a*), FIG. 3(*b*) shows the situation regarding the difference between the pressure on the pressure surface side and the pressure on the suction surface side.
Figure 3B:
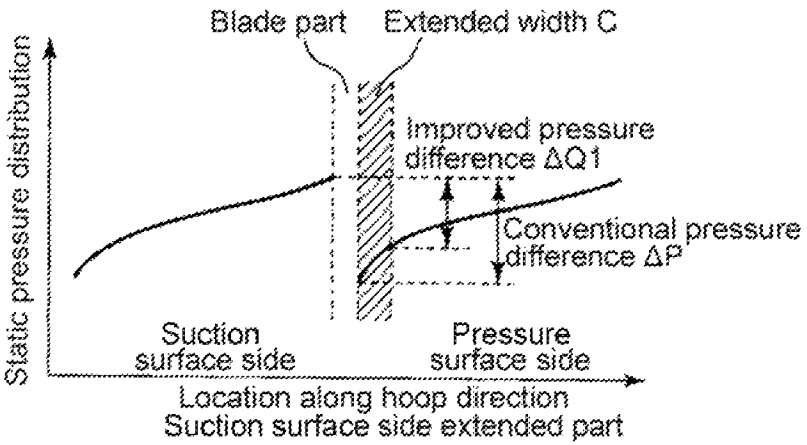

In other words, the exhaust gas collides with the blade part at the location of the pressure surface side inlet where the energy level of the exhaust gas is high and the leakage flow rate level of the gas flow streaming through the rear side of the blade part is great. Further, as shown in FIG. 3(*b*), the static pressure of the exhaust gas distributes along a hoop direction at a blade height level; the distribution rather steeply changes in the area near the suction surface side 19 in comparison with the area near the pressure surface side 21. Accordingly, it is found that, by means of the extended width (extended especially toward the suction surface area) regarding the scallop part 17, the pressure difference between the pressure surface side 19 and the suction surface side 21 can be effectively constrained.

Based on the results of the analysis as well as the findings as described above, the profile of the scallop part is extended toward the suction surface area in the neighborhood of the suction surface 21 of the blade part 5, at least at the tip end side (the leading edge side) of the rear side part of the blade 5. Thus, an suction surface side extended part 25 is formed, the projecting-out width being an almost constant width C along the blade height (along the blade camber line) from the tip end side to the root side of the blade 5. The projecting-out width part is depicted as a strip area of the shaded portion in FIG. 3(*a*).

As described in FIG. 3(*a*), in the rear view of the blade (i.e. the turbine wheel), the envelop of the scallop parts forms a circle of a diameter D2 that may be called the scallop diameter, whereas the outer periphery diameter of the blade part 5 is shown with the symbol D1 (the outer diameter of the blade part). Thus, the height H of the scallop is (D1−D2)/2. Further, the pitch of a blade part and the adjacent blade part along a hoop direction at a height level is shown with the symbol P in FIG. 3(*a*). The extended width C is set in a range from 1/20 to 1/3 of the pitch P at the point of 90% of the height H. For instance, when the number of the blades is 10, the 1/20 of the pitch corresponds to the extended width equivalent to 1.8 degrees; if the extended width is within the width equivalent to 1.8 degrees, the effect on the leakage flow reduction cannot be achieved. The extended width C is preferably wider than 1/12 of the pitch P; namely, the extended width C that is not smaller than the width equivalent to 3.0 degrees is effective in reducing the leakage flow.

In the above context, when the extended width C is smaller than 1/20 of the pitch P, the improved pressure difference ΔQ1 cannot be expected, as shown in FIG. 3(*b*); namely, the conventional pressure difference ΔP between the pressure surface side and the suction surface side cannot be apparently reduced to the improved pressure difference ΔQ1. In other words, when the extended width C is smaller than 1/20 of the pitch P, this expected pressure difference reduction (ΔP−ΔQ1) cannot be expected. On the other hand, when the extended width C exceeds 1/3 of the pitch P, the expected pressure difference reduction (ΔP−ΔQ1) cannot be effectively increased. On the contrary, when the extended width C exceeds 1/3 of the pitch P, the rotational inertia of the wheel increases so that the advantage of adopting the scallop type turbine wheel is spoiled.

In this way, the extended width C is preferably smaller than 1/3 of the pitch P; and, when the extended width C is greater than or equal to 1/12 of the pitch P and the extended width C is smaller than 1/3 of the pitch P, a remarkable pressure difference can be achieved.

FIG. 3(*b*) is further explained. FIG. 3(*b*), shows the situation regarding the static pressure distribution between a blade part 5 and the adjacent blade part 5 along a constant hoop diameter (i.e. in a hoop direction on the back side of the blade parts); two curves are repeatedly depicted; the right curve (on the right side of the blade part) shows the pressure distribution in the pressure side area, whereas the left curve (on the left side of the blade part) shows the pressure distribution in the suction surface side area. The lateral axis denotes the position along the hoop direction; the vertical axis denotes the magnitude of the static pressure. Incidentally, the direction along the constant diameter line from right to left in FIG. 3(*a*) corresponds to the direction from left to right in FIG. 3(*b*); however, the distribution characteristics in FIG. 3(*b*) stay intact. Thus, FIG. 3(*b*) shows the static pressure of the exhaust gas distributes along a hoop direction at a blade height level (90% of the blade height H); the distribution rather steeply changes in the area near the suction surface side 19 in comparison with the area near the pressure surface side 21. Accordingly, by means of the extended width (extended especially toward the suction surface area in the neighborhood of the suction surface side of the blade part) regarding the scallop part 17, the pressure difference between the pressure surface side 19 and the suction surface side 21 can be apparently constrained.

To be more specific, the pressure difference between the pressure surface side and the suction surface side stays at the level of ΔP in a conventional case where no extended part is provided; according to the present mode where the suction surface side extended part is provided on the suction surface side of the blade part, the pressure difference is apparently reduced to the level of ΔQ1. Thus, thanks to this apparent pressure difference reduction from the level of ΔP to the level of ΔQ1, the leakage flow on the rear side of the blade parts can be constrained. Further, the reduced pressure difference of the level of ΔQ1 in a case of the suction surface side extended part is smaller (more efficient) than the reduced pressure difference of the level of ΔQ2 in a case of the pressure surface side extended part; the level of ΔQ2 and the pressure surface side extended part are described later in the second mode of the present invention.

Figure 4:
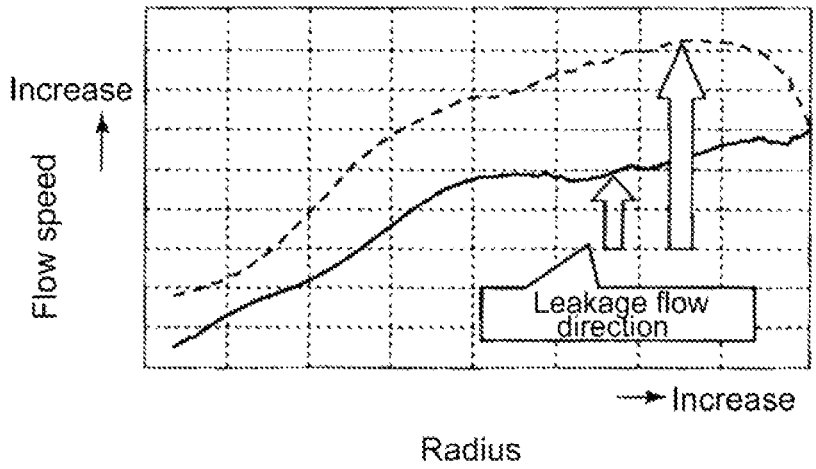
FIG. 4 explains a confirmation result regarding the reduction effect as to the leakage flow, the reduction effect being attributable to the first mode of the present invention.

FIG. 4 explains a confirmation result regarding the reduction effect as to the leakage flow, the reduction effect being attributable to the first mode of the present invention. In FIG. 4, the vertical axis denotes the speed of the leakage flow; the lateral axis denotes the radius of the point on the scallop profile (i.e. the blade height corresponding to the position on the profile). It can be confirmed that the speed of the leakage flow is remarkably reduced at the position of the tip end side (leading edge side) of the blade; it can be also confirmed that the total flow rate of the leakage flow can be reduced. Incidentally, in FIG. 4, the broken line denotes the flow speed in a case where no extended part is provided, whereas the solid line denotes the flow speed in a case where the extended part is provided.

As described thus far, according to the first mode of the present invention, the turbine wheel is provided with the suction surface side extended part 25 on the suction surface side 21 along the scallop part 17; thus, the leakage flow streaming through the gap on the rear side of the blade part 5 from the pressure surface side 19 to the suction surface side 21 can be effectively constrained.

Further, in the above explanation, the suction surface side extended part 25 on the suction surface side is formed so that the projecting-out width is an almost constant width C along the blade height from the tip end side to the root side of the blade. Thereby, the projecting-out width part forms the strip area in the cross section whose plane is at right angles to the rotation axis on the back side of the turbine wheel. However, the projecting-out width part of the width C may be provided mainly on the tip end side of the blade part; or, the projecting-out width part may be provided so that the extended width on the blade root part side is smaller than the extended width on the tip end side; in these events, the weight of the turbine wheel can be further reduced so that the increase in the rotational inertia of the turbine wheel is further constrained. In this way, the quick response performance regarding the turbine can be achieved and the stresses appearing in the turbine wheel 1 can be reduced.

Second Mode

Figure 5A:
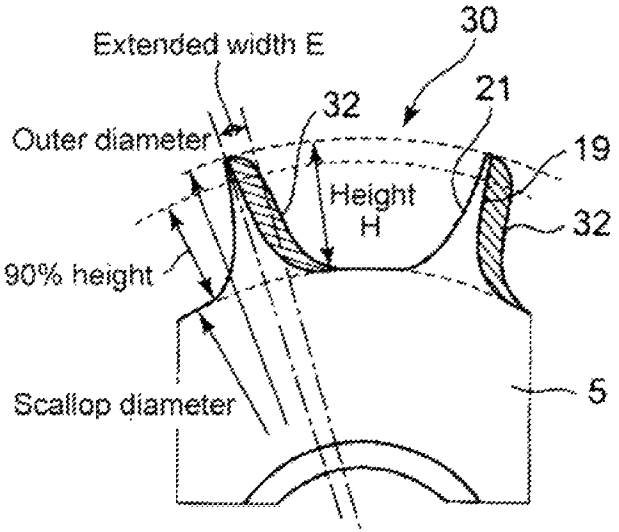
FIG. 5(*a*) shows a scallop profile according to a second mode of the present invention; in relation to FIG. 5(*a*), FIG. 5(*b*) shows the situation regarding the difference between the pressure on the pressure surface side and the pressure on the suction surface side.
Figure 5B:
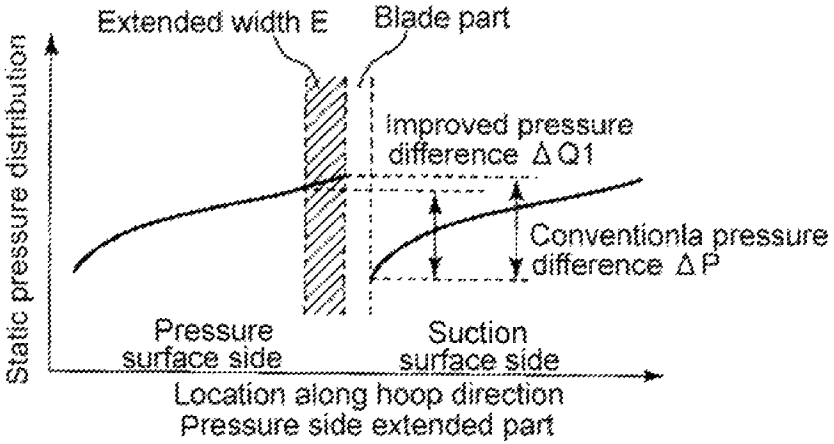

In the next place, based on FIGS. 5(*a*) and 5(*b*), a second mode of the present invention is now explained. Incidentally, the same components in the second mode as in the first mode are given common numerals; and, explanation repetitions are omitted.

As shown in FIG. 5(*a*), in this second mode, the profile of the scallop part 30 is extended toward the (positive) pressure area in the neighborhood of the pressure surface 19 of the blade part 5, at least (mainly) at the tip end side (the leading edge side) of the rear side part of the blade 5.

Thus, an pressure surface side extended part 32 is formed. Thereby, the projecting-out width is an almost constant width E along the blade height from the tip end side to the root side of the blade 5. In addition, the projecting-out width part forms the strip area in the cross section whose plane is at right angles to the rotation axis on the back side of the turbine wheel. Incidentally, the setting conditions regarding the projecting-out width E in this second mode are the same as the setting conditions regarding the projecting-out width C in the first mode.

Based on the configuration as described above, FIG. 5(*b*) explains how the pressure difference between the pressure surface side and the suction surface side changes; in a conventional case where no extended part is provided, the pressure difference between the pressure surface side and the suction surface side stays at the level of ΔP; according to the this second mode where the pressure surface side extended part is provided on the pressure surface side of the blade part, the pressure difference is apparently reduced to the level of ΔQ2. Thus, thanks to this apparent pressure difference reduction from the level of ΔP to the level of ΔQ2, the leakage flow on the rear side of the blade parts can be constrained.

However, the level of Δ Q2 regarding the reduced pressure difference in the second mode is greater (somewhat less efficient) than the level of Δ Q1 regarding the reduced pressure difference in the first mode. As is the case with the first mode, the static pressure distribution rather steeply changes in the area near the suction surface side in comparison with the area near the pressure surface side. Accordingly, by means of the pressure surface side extended part extended in the neighborhood of the pressure surface side of the blade part 5, the pressure difference between the pressure surface side and the suction surface side can be apparently constrained.

As is the case with the first mode, also according to this second mode, by means of the extended part, the increase in the rotational inertia of the turbine wheel can be constrained so that the quick response performance can be achieved; further, the leakage flow behind the rear surface of the blade part can be constrained so that the turbine efficiency can be enhanced.

Further, in the above explanation, the pressure surface side extended part 32 on the pressure surface side is formed so that the projecting-out width is an almost constant width E along the blade height from the tip end side to the root side of the blade. Thereby, the projecting-out width part forms the strip area in the cross section whose plane is at right angles to the rotation axis on the back side of the turbine wheel. However, as is the case with the first mode, the projecting-out width part 32 of the width E may be provided mainly on the tip end side of the blade part; or, the projecting-out width part may be provided so that the extended width on the blade root part side is smaller than the extended width on the tip end side.

Third Mode

Figure 6B:
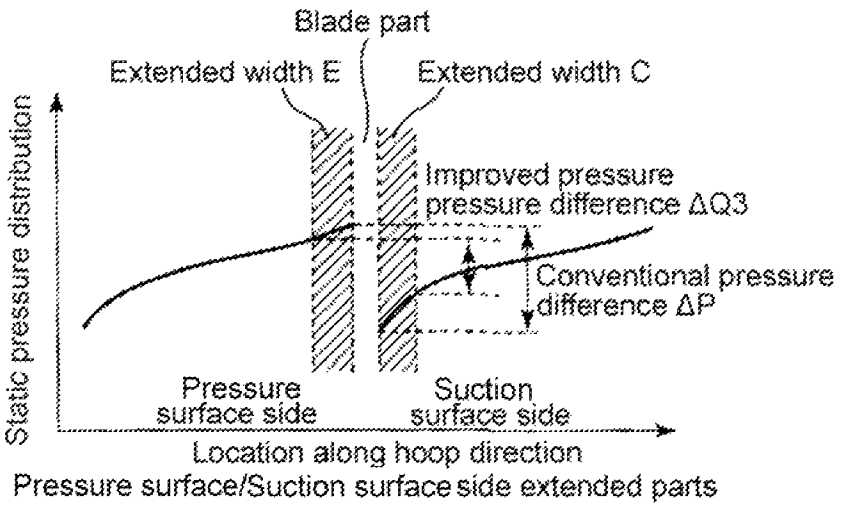
FIG. 6(*a*) shows a scallop profile according to a second mode of the present invention; in relation to FIG. 6(*a*), FIG. 6(*b*) shows the situation regarding the difference between the pressure on the pressure surface side and the pressure on the suction surface side.
Figure 6A:
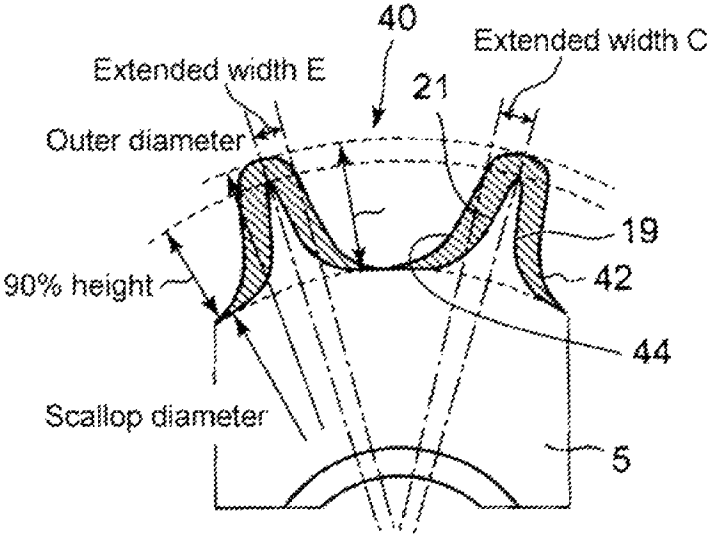

In the next place, based on FIGS. 6(*a*) and 6(*b*), a third mode of the present invention is now explained. Incidentally, the same components in the third mode as in the first and second modes are given common numerals; and, explanation repetitions are omitted.

As shown in FIG. 6(*a*), in this third mode, the profile of the scallop part 40 is extended toward the (positive) pressure area in the neighborhood of the pressure surface 19 of the blade part 5 as well as toward the suction surface area in the neighborhood of the suction surface 21 of the blade part 5, mainly at the tip end side (the leading edge side) of the rear side part of the blade 5. Thus, a pressure surface side extended part 42 as well as a suction surface side extended part 44 is formed.

Thereby, regarding the suction surface side extended part 44 on the suction surface side 21 of the blade part 5, the projecting-out width is an almost constant width C along the blade height from the tip end side to the root side of the blade 5; and, regarding the pressure surface side extended part 42 on the pressure surface side 19, the projecting-out width is an almost constant width E along the blade height from the tip end side to the root side of the blade 5. In addition, each of the projecting-out width parts forms the strip area in the cross section whose plane is at right angles to the rotation axis on the back side of the turbine wheel. Incidentally, the setting conditions regarding the projecting-out width C in this third mode are the same as the setting conditions regarding the projecting-out width C in the first mode; the setting conditions regarding the projecting-out width E in this third mode are the same as the setting conditions regarding the projecting-out width E in the second mode.

Based on the configuration as described above, FIG. 6(*b*) explains how the pressure difference between the pressure surface side and the suction surface side changes; in a conventional case where no extended part is provided, the pressure difference between the pressure surface side and the suction surface side stays at the level of ΔP; according to the this third mode where the suction surface side extended part is provided toward the suction surface area as well as toward the (positive) pressure area, the pressure difference is apparently reduced to the level of ΔQ3. Thus, thanks to this apparent pressure difference reduction from the level of ΔP to the level of ΔQ3, the leakage flow on the rear side of the blade parts can be constrained. Hereby, out of the reduced pressure differences ΔQ1, ΔQ2 and ΔQ3, the difference ΔQ3 according to this third mode is the smallest (most efficient); namely, the leakage flow on the rear side of the blade part is most effectively constrained by providing both the pressure surface side extended part and the suction surface side extended part. In this way, the leakage flow on the rear side of the blade part is remarkably constrained.

Hence, the rotational inertia of the turbine wheel according to the third mode is somewhat increased in comparison with the rotational inertia of the turbine wheel according to the first mode or the second mode. However, the extended parts 42 and 44 may be provided mainly on the tip end side of the blade part; or, the extended parts 42 and 44 may be provided so that the extended width on the blade root part side is smaller than the extended width on the tip end side. For instance, a reverse V-shaped profile of the blade part (in FIG. 6(*b*)) may be an oblong shape profile that includes an arc on the tip end side and almost parallel lines on both the surface sides of the blade part 5; thus, the rotational inertia increase due to the positive extended parts 42 and 44 on both the sides can be constrained, and the leakage flow on the rear side of the blade part is remarkably constrained.

Fourth Mode

Figure 7A:
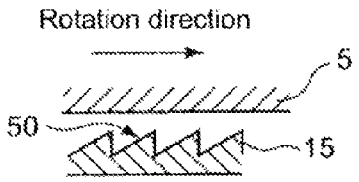
FIGS. 7(*a*) and 7(*b*) are used for explaining a fourth mode (an embodiment) of the present invention.
Figure 7B:
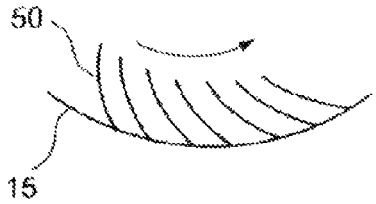
Figure 8A:
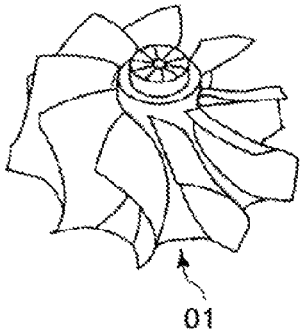
FIGS. 8(*a*) and 8(*b*) show conventional turbine wheels.
Figure 8B:
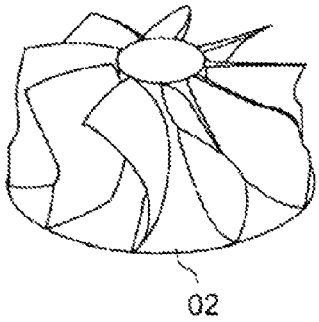
PRIOR ART Fig. 8(b)
Figure 9:
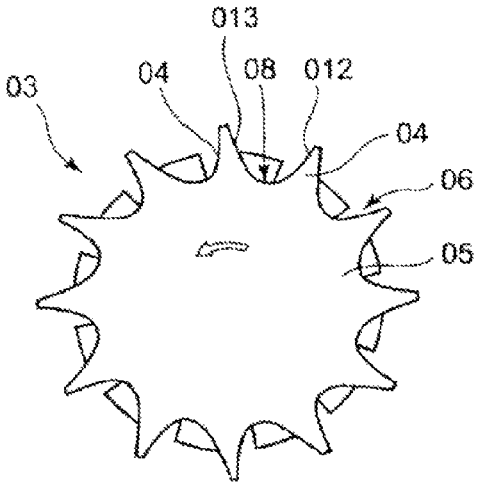
PRIOR ART Fig. 9
FIG. 9 is used for explaining another conventional technology.
Figure 10:
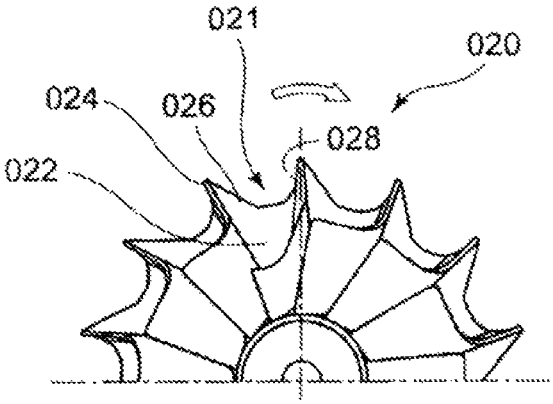
FIG. 10 is used for explaining another conventional technology.

In the next place, based on FIGS. 7(*a*) and 7(*b*), a fourth mode (an embodiment) of the present invention is now explained. Incidentally, the same components in the second mode as in the first to third modes are given common numerals; and, explanation repetitions are omitted.

The back plate 15 faces the turbine wheel (i.e. the back side of the blade parts 5), and forms a back-surface wall facing the turbine wheel. The back-surface wall is annularly formed so as to face the rear back surface of the blade parts 5; thus, the back plate 15 faces the back surface of each blade part; namely, the back plate 15 faces at least one of the suction surface side extended part 25 and the pressure surface side extended part 32.

Further, on the wall surface of the back plate, a plurality of grooves is formed along the radial lines or the spiral curves. The grooves are provided so that the pressure in the gap between the back plate 15 and the rear side surface of the blade part 5 is increased.

In other words, as shown in FIG. 7(*a*), on the wall surface of the back plate 15 that faces the back side of the blade parts 5, a plurality of tapered grooves 50 is formed along the radial directions intersecting at right angles to the rotation (hoop) directions. The grooves are arranged all over the annular wall surface of the back plate. Further, the grooves may be arranged along a plurality of spiral curves in response to the wheel rotation direction, as shown in FIG. 7(*b*).

Further, the effect of the suction surface side extended part 25, 32, 42 or 44 according to the first, second or third mode of the present invention on the reduction of the leakage flow on the rear side of the blade parts can be further enhanced by providing the grooves according to the fourth mode of the present invention.

Further, in this fourth mode as described above, the tapered grooves 50 are provided on the surface of the back plate 15, the surface facing the back side surface of the blade parts 5 (a part of the back side surface of the turbine wheel); however, it goes without saying that the grooves may be provided on the back side surface of the blade parts and the extended parts of the scallop parts.

INDUSTRIAL APPLICABILITY

According to the present invention, the tip end side of the scallop parts (i.e. of the blade parts) are provided with the suction surface side extended parts toward the suction surface area on the suction surface side of the blade part or toward the positive pressure area on the pressure surface side. Thus, the leakage flow on the rear side of the blade parts from the positive pressure area to the suction surface area can be effectively constrained so that the turbocharger efficiency can be enhanced. Hence, the present invention is suitably applied to the turbine wheel provided with the scallop parts.

The invention claimed is:

1. A turbine wheel that comprises a plurality of blades being formed in a scallop shape by cutting-out a back plate side of the blades between a suction surface of a blade and a pressure surface of the adjacent blade, wherein a suction surface side extended part is formed along a tip end part of the scallop shape in the radial direction so as to extend the width of the scallop shape toward the suction surface beyond the thickness of the blades, and the extended width of the suction surface side extended part is set in a range from 1/20 to 1/3 of a pitch which is a distance between adjacent blades at the approximately 90% height of the scallop shape.

2. The turbine wheel according to claim 1, wherein the suction surface side extended part is formed in a strip-shape so that the extended width is approximately constant value from the tip end side to a root side of the scallop shape in the radial direction.

3. The turbine wheel according to claim 1, wherein a groove is formed on a back plate in the radial or spiral direction, the back plate being located facing a back surface of the suction surface side extended part, so as to increase back surface pressure applied to the area between the back surfaces of the blades and the back plate.

4. The turbine wheel according to claim 1, wherein the extended width of the suction surface side extended part is formed so that the extended width on the tip end side is wider than the extended width on a root side of the scallop shape in the radial direction.

5. A turbine wheel that comprises a plurality of blades being formed in a scallop shape by cutting-out a back plate side of the blades between a suction surface of a blade and a pressure surface of the adjacent blade, wherein a pressure surface side extended part is formed along a tip end part of the scallop shape in the radial direction so as to extend the width of the scallop shape toward the pressure surface beyond the thickness of the blades, and the extended width of the pressure surface side extended part is set in a range from 1/20 to 1/3 of a pitch which is a distance between adjacent blades at the approximately 90% height of the scallop shape.

6. The turbine wheel according claim 5, wherein the pressure surface side extended part is formed in a strip-shape so that the extended width is approximately constant value from the tip end side to a root side of the scallop shape in the radial direction.

7. The turbine wheel according to claim 5, wherein a groove is formed on a back plate in the radial or spiral direction, the back plate being located facing a back surface of the pressure surface side extended part, so as to increase back surface pressure applied to the area between the back surfaces of the blades and the back plate.

8. The turbine wheel according to claim 5, wherein the extended width of the pressure surface side extended part is formed so that the extended width on the tip end side is wider than the extended width on a root side of the scallop shape in the radial direction.

9. A turbine wheel that comprises a plurality of blades being formed in a scallop shape by cutting-out a back plate side of the blades between a suction surface of a blade and a pressure surface of the adjacent blade, wherein a pressure surface side extended part and an suction surface side extended part are formed along a tip end part of the scallop shape in the radial direction so as to extend the width of the scallop shape toward the pressure surface and the suction surface beyond the thickness of the blades, respectively, and the extended width of the pressure surface side extended part or the suction surface side extended part is set in a range from 1/20 to 1/3 of a pitch which is a distance between adjacent blades at the approximately 90% height of the scallop shape.

10. The turbine wheel according claim 9, wherein the pressure surface side extended part or the suction surface side extended part is formed in a strip-shape so that the extended width is approximately constant value from the tip end side to a root side of the scallop shape in the radial direction.

11. The turbine wheel according to claim 9, wherein a groove is formed on a back plate in the radial or spiral direction, the back plate being located facing a back surface of at least one of the pressure surface side extended part and the suction surface side extended part, so as to increase back surface pressure applied to the area between the back surfaces of the blades and the back plate.

12. The turbine wheel according to claim 9, wherein the extended width of the pressure surface side extended part or the suction surface side extended part is formed so that the extended width on the tip end side is wider than the extended width on a root side of the scallop shape in the radial direction.

* * * * *